US006183379B1

(12) United States Patent
Kim et al.

(10) Patent No.: US 6,183,379 B1
(45) Date of Patent: Feb. 6, 2001

(54) GOLF PUTTER

(76) Inventors: Sung-Chul Kim, 119-1 Chunpo-ri, Chunpo-Myun, Iksan-si; Jong-Sung Kim, 2-113 Dongnam Samjung Apartment, 27 Chunghwasan-dong 2-ka, Wansan-ku, Chunju-si, both of Chollabuk-Do (KR)

( * ) Notice: Under 35 U.S.C. 154(b), the term of this patent shall be extended for 0 days.

(21) Appl. No.: 09/388,346

(22) Filed: Sep. 1, 1999

(30) Foreign Application Priority Data

May 3, 1999 (KR) ..... 99-15879

(51) Int. Cl.[7] ..... A63B 53/04
(52) U.S. Cl. ..... 473/325; 473/331; 473/330
(58) Field of Search ..... 473/324, 330, 473/331, 342, 257, 254, 340, 341, 313, 314, 325; D21/736, 742, 746, 750, 751

(56) References Cited

U.S. PATENT DOCUMENTS 1,094,599 * 4/1914 Samson .
3,392,977 * 7/1968 Delacey .
3,632,112 * 1/1972 Jacobs .
3,819,180 * 6/1974 Murphy .
3,881,733 * 5/1975 Csernits .
4,290,606 * 9/1981 Maxwell .
4,529,203 * 7/1985 Ribaudo .
4,846,477 * 7/1989 Phelan .
5,505,450 * 4/1996 Stuff .
5,961,392 * 10/1999 Hillock .
6,045,452 * 4/2000 Ahn .

* cited by examiner

*Primary Examiner*—Sebastiano Passaniti
(74) *Attorney, Agent, or Firm*—Darby & Darby

(57) ABSTRACT

A golf putter including a head having a face, a shaft and a grip. The face comprises a centered first face, a second face formed on one side of the first face and inclined inwardly, and a third face formed on the other side of the first face and inclined inwardly. A plurality of friction protrusions are formed on the surface of the first face for improving the contact resistance. A plurality of spin protrusions are formed in the shape of steps on the surface of the second and third faces, respectively, so that a golf ball collided therewith rotates inwardly. Therefore, under any topographical condition, that is, a relatively flat green or an inclined green, the golfer can putt the ball directly into the hole without having to consider the curvature of the golf ball to the right or left side, thereby improving the accuracy of the putting operation.

6 Claims, 5 Drawing Sheets

FIG. 8
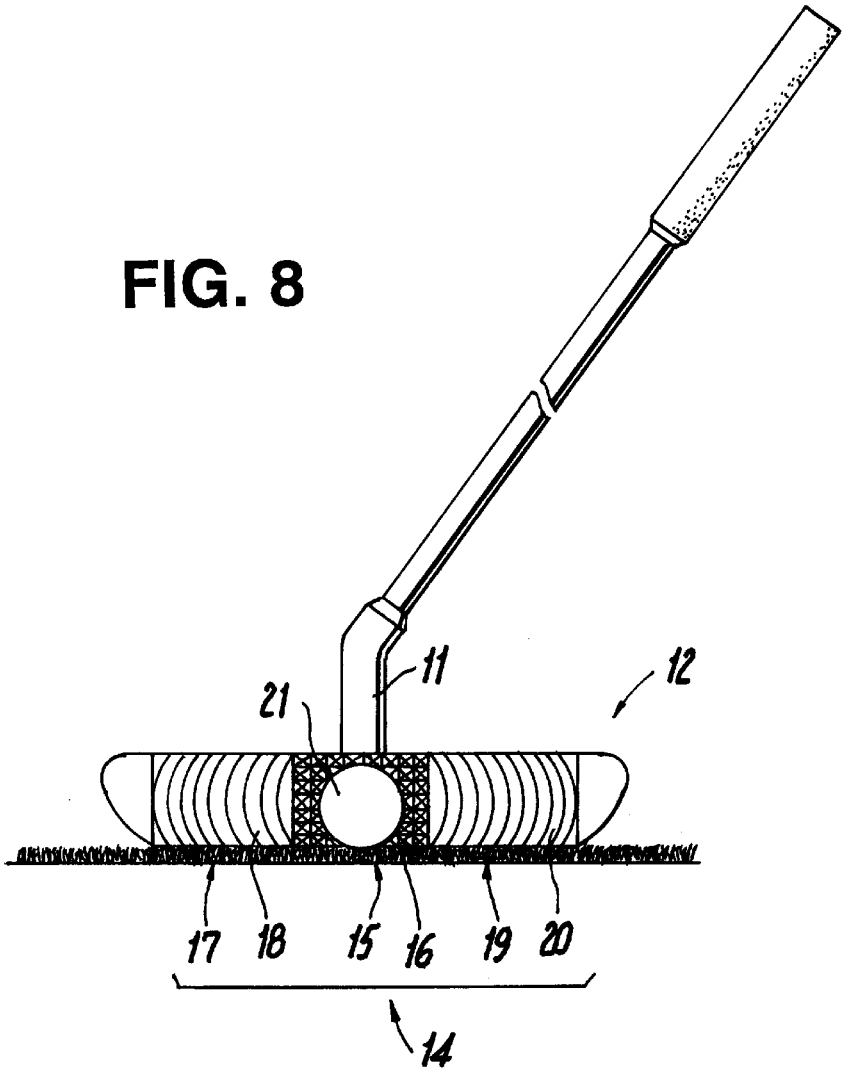
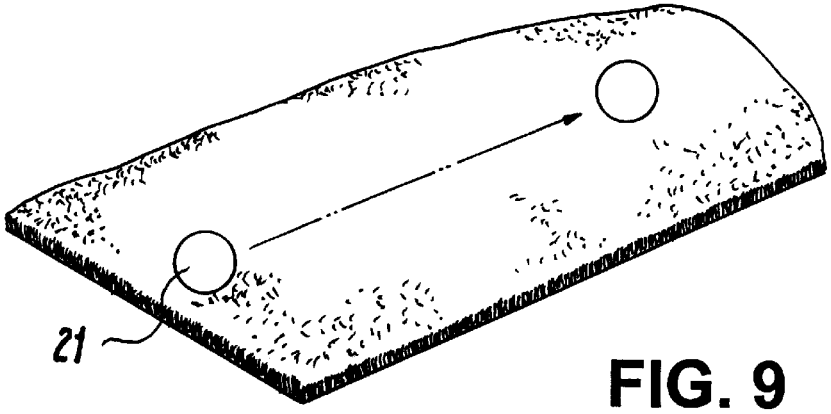
FIG. 9

FIG. 10
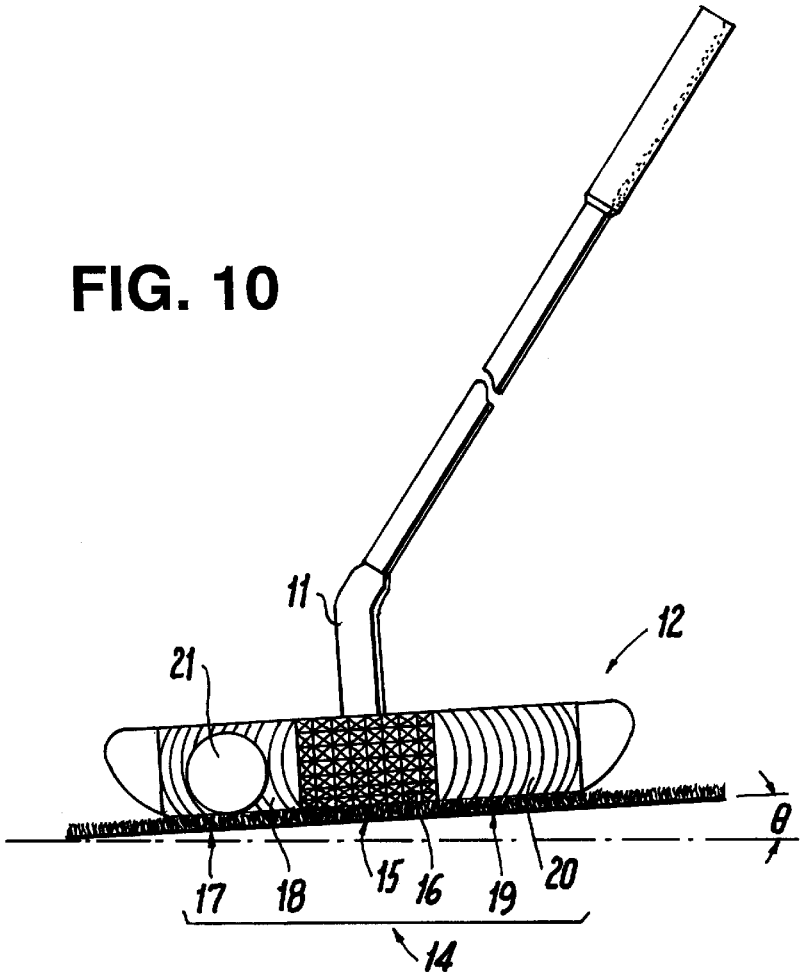
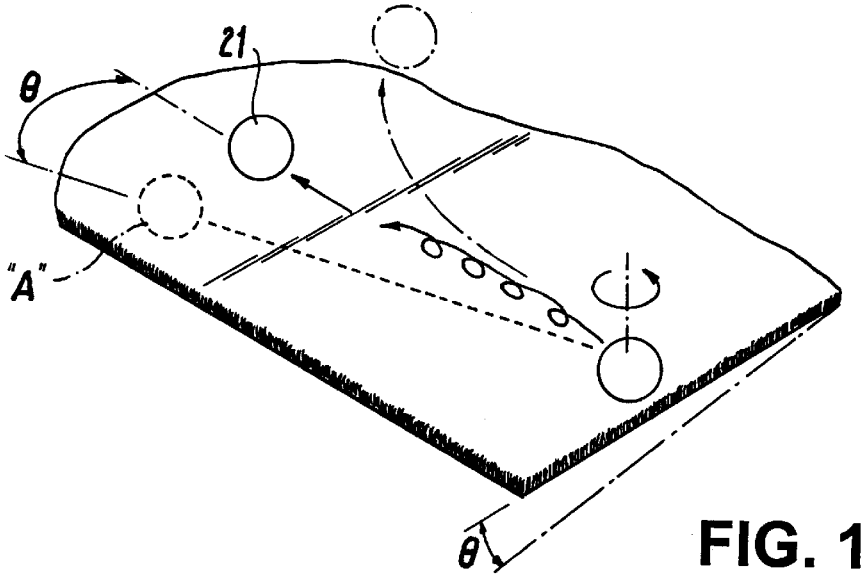
FIG. 11

GOLF PUTTER

FIELD OF THE INVENTION

The present invention relates to a golf putter, and more particularly to a golf putter with which a golfer can putt a golf ball effectively to a desired direction under any topographical condition, such as in a relatively flat green, in a state of lawn inclined to one direction and in a inclined green.

DESCRIPTION OF THE RELATED ART

Golf clubs are generally divided into wood clubs, iron clubs and putters, each have various types according to the flying distance and hitting angle.

Among these golf clubs, the putter is mainly used on a green for rolling a golf ball rather than hitting the ball strongly, and is generally classified into a T-type, an L-type, a Pin-type and an egg-type.

FIG. 1 is a front view showing the L-type putter, including a head 1, a shaft 2 and a grip 3. Since such a golf putter is one of the golf clubs used in the last step for inserting the ball into a hole, it is required to be delicate in a putting step, different from that of the iron club or the wood club.

Therefore, if the flowing angle of the ball is shifted a little due to various factor, such as the contact angle and friction the force between the ball and the face (a hit surface) of head 1, the final position of ball deviates far away from the hole.

FIGS. 2 and 3 are partial perspective views showing the problem that occurs when putting with the conventional golf putter. FIG. 2 shows the putting state in a lawn lain down to one side and FIG. 3 shows the putting state in a ground inclined to one side at a particular angle.

In FIG. 2, even though the golfer hits the ball 4 in a straight line, it curves toward the inclined direction of the lawn as the velocity of the ball 4 decreases. Therefore, the ball 4 deviates far away from the desired final position.

In FIG. 3, even though the golfer hits the ball 4 in a straight line the inclined direction of the green according to the decrease of velocity of the ball 4 decreases. Therefore, the ball 4 deviates far away from the desired final position.

SUMMARY OF THE INVENTION

An object of the present invention is to provide a golf putter with which a golfer can hit a golf ball effectively to a desired direction under any topographical condition, such as in a relatively flat green, in a state of lawn lain down to one direction and in a inclined green.

To achieve these and other advantages and in accordance with the purpose of the present invention as embodied and broadly described, a golf putter comprises a head having a face, a shaft and a grip. The face comprises a first face formed on the center thereof, a second face formed on one side of the first face and inclined inwardly, and a third face formed on the other side of the first face and inclined inwardly.

According to one aspect of the present invention, a plurality of friction protrusions are further formed on the surface of the first face for improving contact resistance between the first face and a golf ball to be collided with.

According to another aspect of the present invention, a plurality of spin protrusions are formed on the surface of the second and the third face respectively in the shape of steps, so that a golf ball when collided with might be rotates inwardly.

Preferably, the second and the third face is inclined inwardly at an approximately 10° angle and a plurality of spin protrusions formed on the second and the third face in the shape of steps are preferably formed symmetrically centered about said first face, and most preferably may be circular arc centering around the first face so that the golf ball being collided with might be rotated inwardly.

Therefore, on a relatively flat green of the in which the flow of golf ball is almost not affected by the inclination of the lawn or the ground, the golf ball travels straight an the desired hitting direction without shaken or being pushed by means of the friction protrusions formed on the first face of the head, to thereby improve the accuracy of the putting operation. In addition, on a inclined green of the lain down lawn in which the flow of golf ball is affected by the inclination of the lawn or the green, the spin protrusions formed on the surface of the second or the third faces compensate in the above condition, so that the golfer can hit the ball directly for the hole without having to take into consideration the curvature of the golf ball to right or left side, to thereby further improve the accuracy of the putting operation.

It is to be understood that both the foregoing general description and the following detailed description are exemplary and explanatory and are intended to provide further explanation of the invention as claimed.

BRIEF DESCRIPTION OF THE DRAWINGS

In the accompanying drawings:

FIGS. 8 and 9 are a partial front cross sectional view and a perspective view, respectively, showing the putting state on a flat green;

FIGS. 10 and 11 are a partial front cross sectional view and a perspective view, respectively, showing the putting state in a green inclined to one direction.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be constructed as limited to the embodiments set forth herein; rather, these embodiments are provided so that this disclosure will be thorough and complete, and will fully convey the scope of the invention to those skilled in the art.

Figure 1:
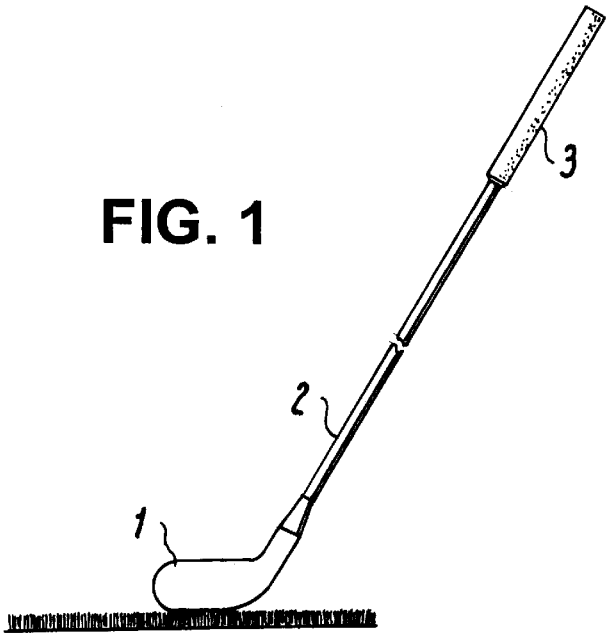
FIG. 1 is a front view showing a conventional golf putter.
Figure 2:
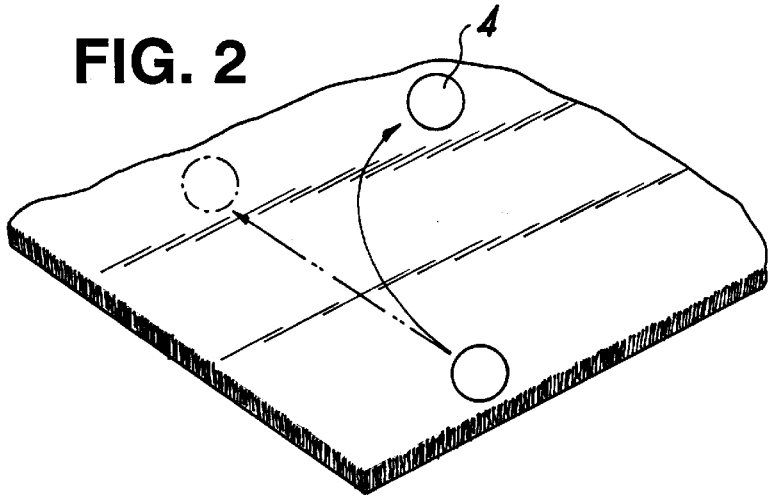
FIGS. 2 and 3 are partial perspective views showing the problem that occurs in putting with the conventional golf putter.
Figure 3:
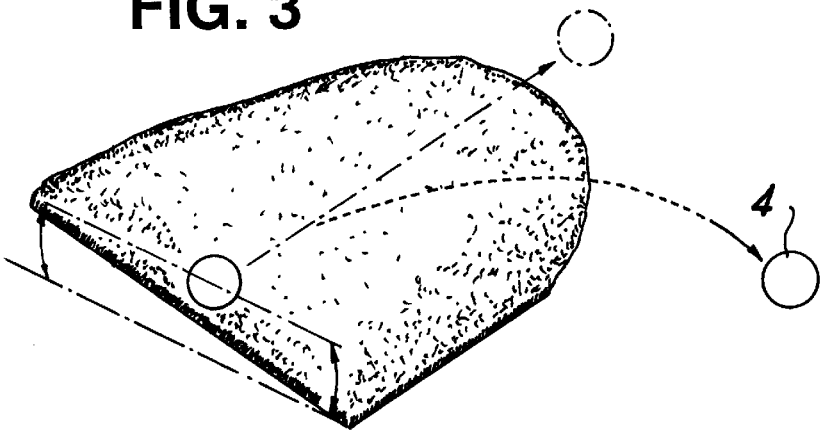
Figure 4:
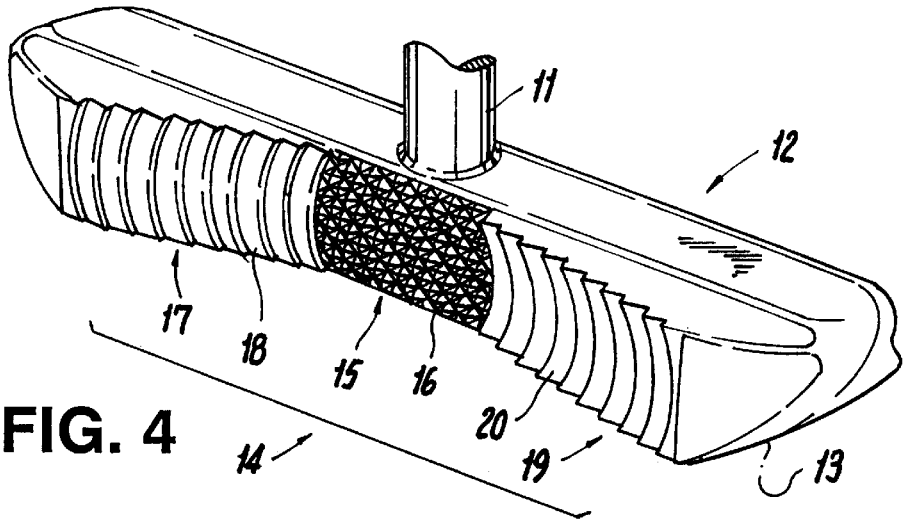
FIG. 4 is a partial perspective showing a golf putter according to one embodiment of the present invention.
Figure 5:
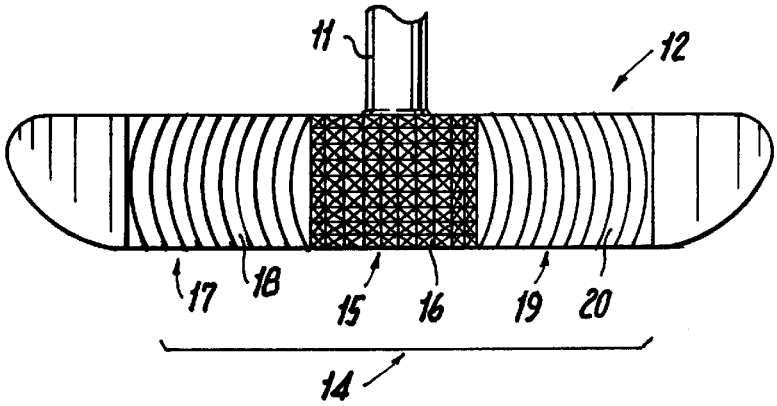
FIGS. 5 to 7 are front, side and plan views respectively, showing a head of the golf putter according to one embodiment of the present invention.
Figure 6:
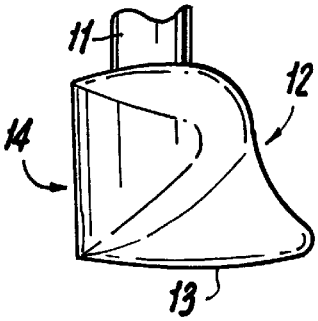
Figure 7:
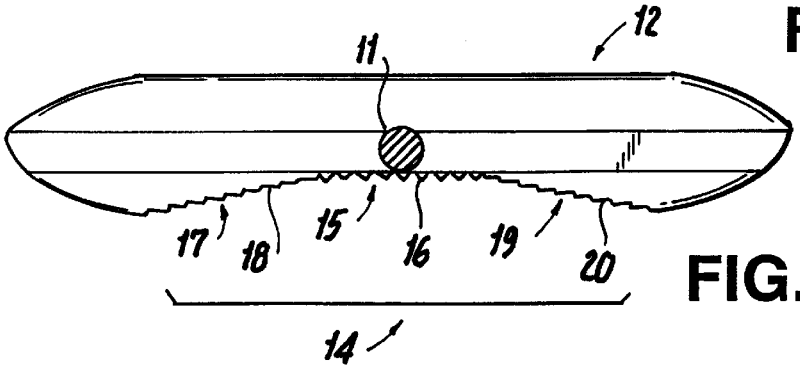

FIG. 4 is a partial perspective view showing a golf putter according to one embodiment of the present invention. FIGS. 5 to 7 are front, side and plan views respectively showing a head of the golf putter according to one embodiment of the present invention. Referring to FIGS. 4 to 7, the golf putter according to the present invention is composed of a head 12, a shaft 11 and a grip (not shown). The shaft 11 is connected to the center of the head 12 minimize shaking of the head might be minimized.

A face 14 is provided on the front surface of the head 12 for hitting a golf ball. A round surface 13 is provided on the bottom surface of the head 12 to prevent the head 12 from being caught in the lawn or ground.

The face 14 is divided into a first face 15, a second face 17 and a third face 19. The first face 15 is a flat and perpendicular plane. The second face 17 and the third face 19 respectively are arranged to the sides of the first face and inclined inwardly, namely to the front direction of the face 14 at approximately a 10° angle.

Therefore, if a right handed golfer hits a ball in a front straight direction using the second face 17, the ball travels to the left of the front straight direction at approximately a 10° angle. On the other hand, if using the third face 19, the ball travels to for the right of the front straight direction at approximately a 10° angle.

In the meanwhile, a plurality of friction protrusions 16 are provided on the surface of the first face 15 of the head 12, and a plurality of spin protrusions 18 and 20 are provided symmetrically centering around the first face 15 and successively in the shape of steps on the surface of the second face 17 and the third face 19 respectively. The spin protrusions 18 and 20 are in the shape of circular arcs centering the first face 15.

With the construction of the above golf putter in accordance with the present invention, the golfer when putting the ball can select of one face among the first face 15, the second face from 17 and the third face 19 depending on the state of the lawn or ground, namely the inclination degree and direction of the lawn and ground of the golf green.

If the lawn and the ground are substantially flat without inclination, as shown in FIG. 8 and 9, the golfer when putting the ball uses the first face 15 of the head 12. FIGS. 8 and 9 are a partial front cross sectional view, and a perspective view respectively, showing the putting state on a flat green.

While putting under the above condition, it is important to putt the ball so that it travels straight ahead without the side flow of the ball. If the hitting surface of the putter is plain and smooth as with conventional putters, the contact surface between the ball and the putter is small as one point. As a result of the ball may be shaken or the contact surface may be pushed in the instant of the putting. These factors often causes the ball to deviate from a straight path, so that the ball does not fall into the hole.

To solve such a problem, a plurality of friction protrusions 16 are provided on the surface of the first face 15. These friction protrusions 16 provide a larger contact surface between the ball 21 and the face 15 of the head 12, thereby increasing the contact force so that the ball 21 travels straight ahead without shaken or being pushed.

When putting the ball 21 with the first face 15, a number of friction protrusions simultaneously contact with the ball 21 thereby increasing, the contact resistance between the ball 21 and the first face 15.

As a result of, the ball 21 travels straight ahead without shaken or being pushed, thereby increasing the probability of inserting the ball into the hole compared to conventional putters.

In the meanwhile, FIGS. 10 and 11 are a partial front cross sectional view and a perspective view, respectively, showing the putting state in a green inclined to one direction. Under the condition that the lawn is lain down to one side, namely the field is inclined downwardly, when a right handed golfer putts the ball 21 in the direction of an arrow in FIG. 11 using the conventional putter, the ball 21 travels down along the inclined surface of the green as indicated by the imaginary line in FIG. 11.

Therefore, when using of the conventional putter, the golfer must putt the ball 21 for the "A" position in consideration that the ball 21 travels down along the inclined surface of the green. However, since even a highly-skilled golfer often makes a mistake while putting and fails to consider such an inclined angle, it is very difficult for the average golfer to putt precisely with the control of power and angle in consideration of the inclined surface. As a result, the ball often deviates from the hole when using a conventional golf putter.

However, under the condition as shown in FIG. 10 and 11, namely under the condition that the right handed golfer must putt the ball 21 in the direction the arrow in FIG. 11. If the green is at a right downward incline, the golfer putts the ball using the second face 17 of the putter of the present invention.

If the golfer putts the ball 21 straight for the hole, the putted ball tends to travel down along the imaginary line due to the inclination of the lawn surface. However, since the ball 21 putted with the second face 17 inclined inwardly at approximately a 10° angle is putted for the "A" position and the ball 21 rotates in the counter-clockwise direction by means of the spin protrusions 18, the ball 21, as a result, travels straight ahead and compensates for the operation of the inclined surface of the lawn by the inclined angle of the second face 17 and the operation of the spin protrusions 18.

Therefore, under the condition of FIGS. 10 and 11, the golfer using the putter in accordance with the present invention can simply putt the ball 21 in a straight line without taking into account the travel of the ball along the inclined surface, to thereby improve the putting accuracy.

Figure 12:
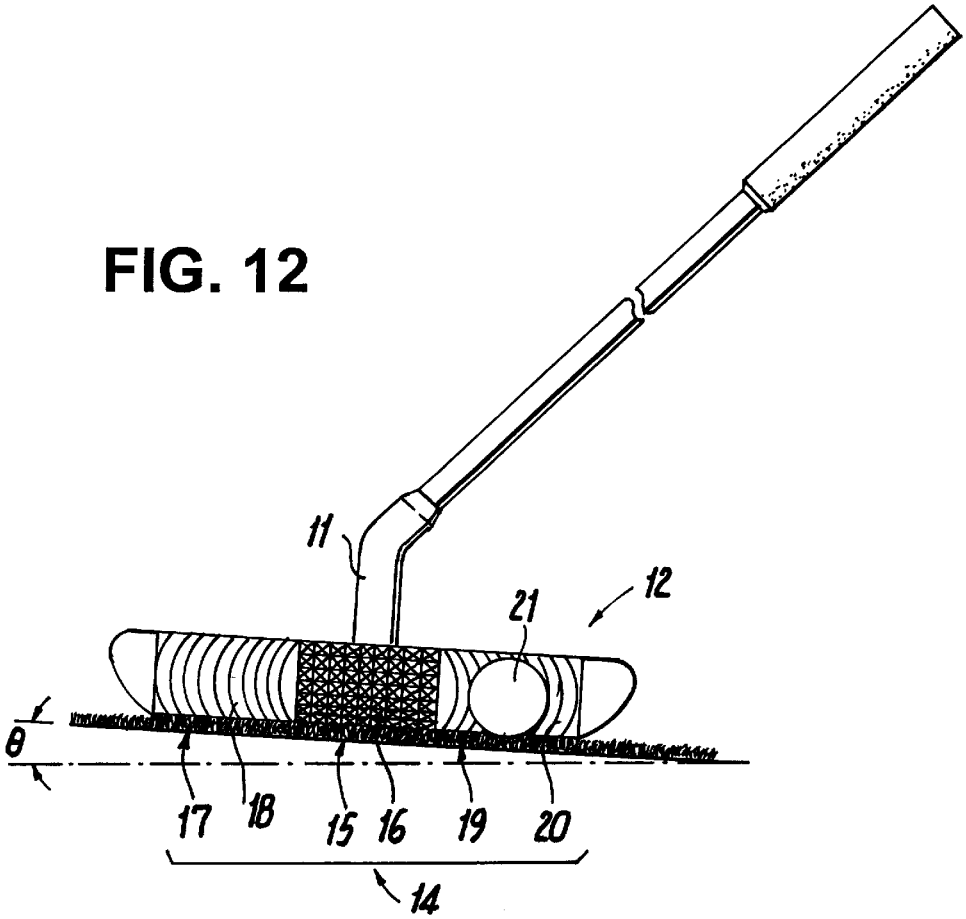
FIGS. 12 and 13 are a partial front cross sectional view and a perspective view, respectively, showing the putting state in a green inclined to the opposite direction of FIGS. 10 and 11.
Figure 13:
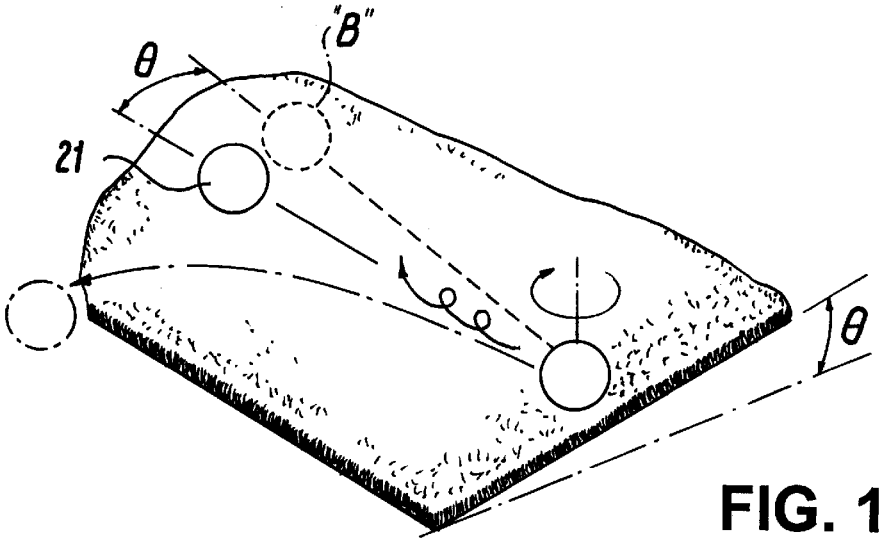

In the meanwhile, FIGS. 12 and 13 are a partial front cross sectional view and a perspective view, respectively, showing the putting state in a green inclined in a opposite direction FIGS. 10 and 11. In the situation in which the field is inclined upwardly, when a right handed golfer putts the ball 21 in the direction of the arrow in FIG. 13, the golfer can putt using the third face 19 of the putter 12 of this invention.

As in the case of FIGS. 10 and 11, if the golfer putts the ball 21 straight for the hole, the putted ball tends to travel down along the imaginary line of FIG. 13 due to the inclination of the field surface. However, the ball 21 putted with the third face 19 inclined inwardly at approximately a 10° angle is putted for the "B" position and the ball 21 rotates in the clockwise direction by means of the spin protrusions 20. As a result goes straight ahead compensates for the inclined surface of the lawn by the inclined angle of the third face 19 and the operation of the spin protrusions 20.

Therefore, under the condition in FIGS. 12 and 13, the golfer using the putter in accordance with the present invention can simply putt the ball 21 in a straight line without taking into account the travel of the ball along the inclined surface, to thereby improve the putting accuracy.

When using the golf putter in accordance with the present invention, while on a relatively flat green the travel of golf ball 21 is substantially unaffected by the inclination of the lawn or the ground, so that the golfer can putt the golf ball straight in the desired hitting direction without being shaken or pushed because of the friction protrusions 16 formed on the first face 15 of head 12. On an inclined green or a lain down lawn the travel of the golf ball is affected by the inclination of the lawn or the green. Since the spin protrusions 18 and 20 formed on the surface of the second face 17 or the third face 19 can compensate for the above affect, the golfer can putt the ball straight into the hole without considering the curvature of the golf ball to right or left side, to thereby improving the accuracy of the putting operation.

Additional advantages and modifications will readily occur to those skilled in the art. Therefore, the invention in its broader aspects is not limited to the specific details shown and described therein. Accordingly, various modifications may be made without departing from the spirit or scope of the general inventive concept as defined by the appended claims and their equivalents.

What is claimed is:

1. A golf putter comprising:

a head having a face, said face comprising a centered first face, a second face formed to one side of said first face and inclined inward towards said first face, and a third face formed on an opposite side of said first face and inclined inward towards said first face, a plurality of spin protrusions are formed on the surface of said second and third face respectively in the shape of steps sloping inward toward said first face so that a golf ball upon impact rotates inwardly;

a shaft; and a grip.

2. The golf putter in accordance with claim 1, wherein a plurality of friction protrusions are formed on the surface of said first face for improving of a contact resistance between said first face and a golf ball to be collided with.

3. The golf putter in accordance with claim 1, wherein each of said second and third faces are inclined inward towards said first face at approximately a 10° angle.

4. The golf putter in accordance with claim 1, wherein said spin protrusions are formed in the shape of a circular arc centered about said first face.

5. The golf putter in accordance with claim 1, wherein said shaft is connected to the center of said head.

6. The golf putter in accordance with claim 1, wherein said second face and said third face are symmetrically centered about said first face.

* * * * *